US005464497A

United States Patent [19]

Unthank

[11] Patent Number: 5,464,497

[45] Date of Patent: Nov. 7, 1995

[54] APPARATUS FOR CONTINUAL APPLICATION ON A CONTINUOUS MATERIAL WEB

[75] Inventor: Robert J. Unthank, Georgetown, Canada

[73] Assignee: Tetra Laval Holdings & Finance S.A., Pully, Switzerland

[21] Appl. No.: 151,892

[22] Filed: Nov. 15, 1993

[30] Foreign Application Priority Data

Nov. 24, 1992 [SE] Sweden ..... 9203524

[51] Int. Cl.[6] ..... B30B 15/34

[52] U.S. Cl. ..... 156/519; 156/265; 156/552; 156/582; 156/583.8

[58] Field of Search ..... 156/265, 519, 156/521, 552, 580, 581, 582, 583.1, 583.8; 100/93 P, 93 RP, 156; 53/135.3; 493/214, 215

[56] References Cited

U.S. PATENT DOCUMENTS

| | | | |
|---|---|---|---|
| 2,254,217 | 9/1941 | Grupe | 156/519 X |
| 2,990,081 | 6/1961 | De Neui et al. | 156/519 |
| 3,879,246 | 4/1975 | Walker | 156/265 |
| 4,421,589 | 12/1983 | Armini et al. | 156/382 |
| 4,547,255 | 10/1985 | Yow | 156/580 |
| 4,765,118 | 8/1988 | Akutsu et al. | 156/519 X |
| 4,795,510 | 1/1989 | Wittrock et al. | 156/64 |
| 5,024,719 | 6/1991 | Heck et al. | 156/522 |

FOREIGN PATENT DOCUMENTS

| | | |
|---|---|---|
| 0368168 | 5/1990 | European Pat. Off. . |
| 1044704 | 11/1958 | Germany . |
| 466952 | 11/1958 | Sweden . |
| 317246 | 11/1969 | Sweden . |
| 452874 | 12/1987 | Sweden . |
| 455598 | 8/1988 | Sweden . |

*Primary Examiner*—David A. Simmons
*Assistant Examiner*—J. Sells
*Attorney, Agent, or Firm*—Burns, Doane, Swecker & Mathis

[57] ABSTRACT

The invention relates to an apparatus for the continual application of cut pieces of a strip to a continuous material web. The apparatus includes a station drum provided with a plurality of sealing devices. The strip pieces are transported to the sealing devices by transport rollers, which cut the strip into pieces. The continuous material web passes the sealing devices and the strip pieces are sealed to the material web. The material web is kept in register by means of a register maintenance device.

20 Claims, 2 Drawing Sheets

APPARATUS FOR CONTINUAL APPLICATION ON A CONTINUOUS MATERIAL WEB

FIELD OF THE INVENTION

The present invention relates to an apparatus for the continual application of cut pieces of a strip to a continuous material web.

BACKGROUND OF THE INVENTION

Within the packaging industry, it is common to provide a continuous material web with some form of strip in pieces. The strip pieces may, for example, constitute an opening arrangement in which the strip covers a pre-punched hole, a so-called pull-tab, or, when the strip is placed in a sealing seam, a so-called spout strip. The strips may also be in the form of labels or other identification. As regards application of strips which constitute opening arrangements, this normally takes place intermittently in that the web is arrested in its movement and the strip is sealed in place over a pre-punched hole, as disclosed in, for example, Swedish Patent Specification SE 317246. It is, however, desirable to increase the speed of this type of strip application and to render it continual. Apparatuses for performing strip application must, however, be reliable and be able to locate the strip in its intended place. Furthermore, such apparatuses must be capable of being adapted to rapid, modern filling machines and be capable of being integrated in them.

OBJECTS AND SUMMARY

One object of the present invention is to provide means for continual application of strip pieces on a continuous material web so that the speed of the filling machine need not be reduced as a result of this operational phase. Furthermore, application of the strips must take place exactly and observe due maintenance of register. The apparatus must also be capable of being integrated or retrofitted in a filling machine and be capable in a simple manner of integration into the control system of the filling machine.

These and other objects are attained according to the present invention in that the apparatus of the type disclosed by way of introduction includes means for displacing the material web, rollers for transporting the strip, means for register maintenance between the material web and the strip and a plurality of sealing devices which are placed about the periphery on a station drum and are operative to receive, transfer to the material web and there fixedly seal the strip pieces.

BRIEF DESCRIPTION OF THE ACCOMPANYING DRAWINGS

One preferred embodiment of the present invention will now be described in greater detail hereinbelow, with particular reference to the accompanying Drawings, in which.

The Drawings show only those parts and details essential to an understanding of the present invention.

DETAILED DESCRIPTION

The apparatus as illustrated in FIG. 4 is preferably integrated in a filling machine, such as at a point where a material web 1 enters the filling machine and before the material web 1 reaches a sterilization bath. Thereafter, the material web 1 is formed into a tube, filled with the intended contents and cut into individual packages. The apparatus may naturally also be placed outside the filling machine and there prepare the material web 1 with application of the contemplated strip pieces. The major features of the apparatus, a station drum 2, means for displacing the material web, rollers for transporting the strip and a register maintenance device are preferably mechanically interconnected by belts or a common master shaft. These parts can also be wholly or partly connected to separate drive units.

Figure 1:
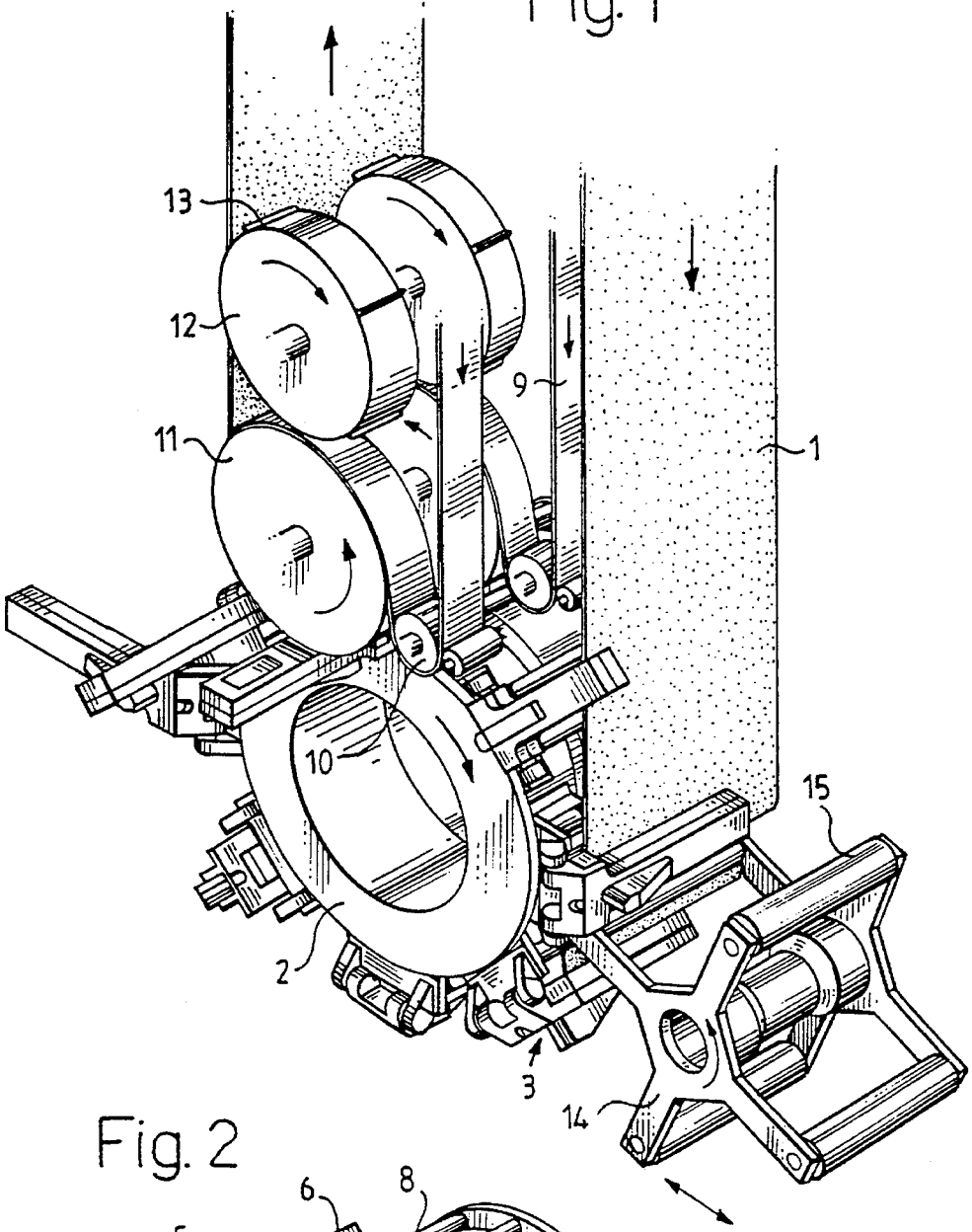
FIG. 1 is a perspective view of an apparatus according to an embodiment of the invention.
Figure 2:
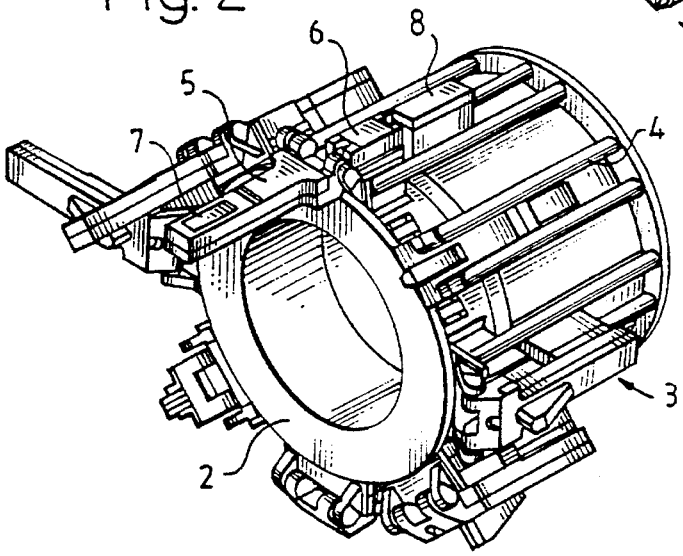
FIG. 2 is a perspective view of a station drum according to an embodiment of the invention.

The station drum 2 forms the central unit of the apparatus and is provided with a number of sealing devices 3 which are preferably axially disposed about the periphery of the station drum 2. In FIGS. 1 and 2, a station drum 2 is shown with eight sealing devices 3. Naturally, the sealing devices 3 may be more or fewer in number. A large number of sealing devices 3 imparts to the apparatus a higher workrate at the same time as the station drum 2 and thereby the apparatus in its entirety will take up more room. The number of sealing devices 3 is selected in view of the speed of the packaging machine and the volume of those packages which are to be packed in the filling machine. The number of sealing devices 3 must also be so great that the sealing devices have time to execute a tight seal before the material web 1 leaves the station drum 2.

A number of idlers 4 are placed between the sealing devices 3 on the station drum 2. A purpose of the idlers 4 is to prevent that part of the material web 1 which is not to be sealed from coming into unnecessary contact with the sealing devices 3 and in such instance becoming exposed to undesirable wear.

The sealing devices 3 include of two parts—an upper 5 and a lower 6—each connected to a vacuum source. The upper part 5 of the sealing device 3 may assume two positions, an open position where the upper sealing device part 5 is spring-biased and is located at its greatest distance from the lower part 6, and a closed position where the upper part 5 is lowered over the lower part 6. The lower part 6 is connected to a pneumatic piston and cylinder assembly (not shown) and may move between two positions, an activated position where the lower part 6 is located at its greatest distance from the centre point of the station drum 2 and a deactivated position where the lower part 6 is located most proximal the centre point of the station drum 2. Both parts 5 and 6 of the sealing device 3 are disposed to receive one or two strips and, with the aid of the vacuum source, to retain these on the two sealing device parts 5 and 6 prior to sealing on the material web 1.

The means for displacing the material web include the extension of the sealing device 3 and are, in the preferred embodiment, thus placed about the periphery of the station drum 2. The displacement means include two parts 7 and 8 of which the upper part 7 is placed in the extension of the upper sealing device part 5 and the lower part 8 is placed in the extension of the lower sealing device part 6. When the upper sealing device part 5 is lowered over the lower sealing device part 6, the upper part 7 of the displacement means will thus be lowered over the lower part 8 of the displacement means. The displacement means are operative to grasp the material web 1 and draw the web through the apparatus. It is also possible to site the displacement means wholly separate and discrete from the sealing devices 3 and the station drum 2.

The material web 1 is prepared for the apparatus in such a manner that, before the material web 1 reaches the station drum 2, it passes a hole-making unit (not shown). The hole-making unit, which may be of conventional type with a rotary punch against a counter roller, can be driven by the same common drive train as the, other component parts included in the apparatus. The hole-making unit is placed such that it is adapted to the register length of the material web 1, i.e., the distance between two packages on the material web 1, so that the holes are always situated at their intended position.

Rollers for transporting a strip 9 may include of one or, as shown in FIG. 1, two separate units. The one unit is intended to cover the holes of the material web 1 from the outside of the package, the so-called pull-tab, which is torn off on opening of the package. The other unit covers the holes of the material web 1 from the inside of the package, the so-called cover strip which insulates the edges of the hole from the contents of the package. The rollers include a feed roller 10 which, by moving different distances, determines the length of the strip piece. A transfer roller 11, whose surface is provided with holes connected to a vacuum source, is operative to retain the strip 9 and the strip pieces on its surface. Further, the transport rollers include a knife roller 12 with a number of knives 13 placed about its periphery which cut towards the transfer roller 11. Where the knife roller 12 comes into engagement with the transfer roller 11, the transfer roller 11 may be provided with inlays of a harder material such as, for example, tungsten carbide. The transfer roller 11 is operative to move the strip piece further to the sealing devices 3. Since the knife roller 12 is not placed in the immediate vicinity of the hot sealing devices 3, the risk will be avoided that the knives become coated with molten thermoplastic.

Figure 3:
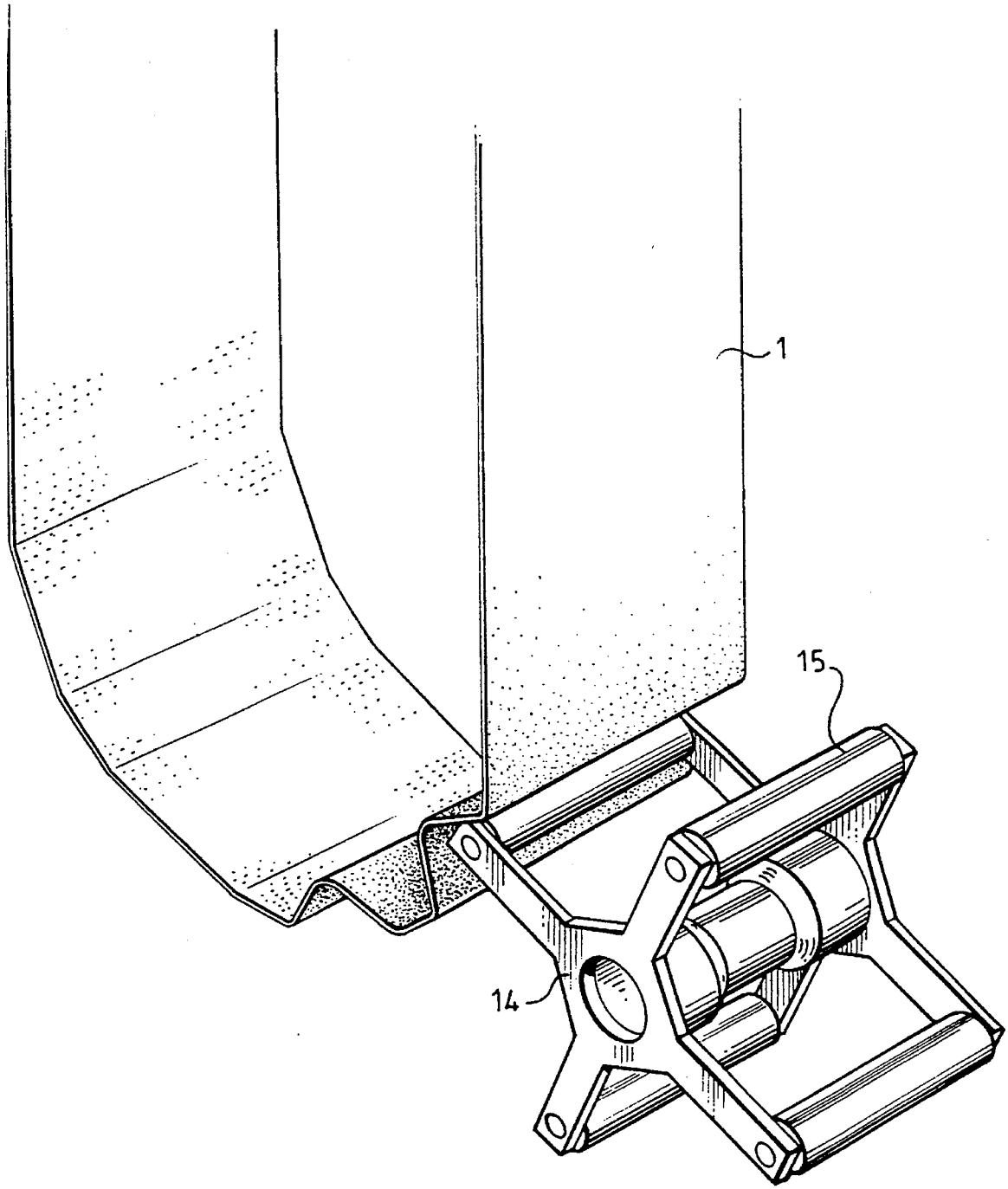
FIG. 3 is a perspective view of a register maintenance device according to an embodiment of the invention.

The apparatus also includes a register maintenance device. The continuous material web 1 is intended to be divided into separate packages and, since these carry artwork décor which is kept in register, it is desirable that the strip 9 always be situated at the same position on the package. The strip 9 must also be placed correctly in relation to any possible holes with regard to so-called pull-tab openings or with regard to a package seam for so-called spout strip opening. The register maintenance device according to the invention includes a wheel 14 with a number of rollers 15 arranged axially. The rollers 15 may be three or more in number. FIG. 3 shows the wheel 14 of the register maintenance device with four rollers 15. The register maintenance device is disposed to execute not only a rotary movement but also a transverse movement in relation to the material web 1, so that it presses on the web 1. The transverse movement may be reversible and be rapidly modified with slight variations. The variations are preferably between 0.05 and 0.1 mm.

The material web 1 enters the filling machine from some form of magazine reel (not shown). For strip application relating to so-called pull-tab openings, the material web 1 first passes a hole-making unit (not shown). The location of the hole-making unit is determined by register length and other parts included in the apparatus. The material web 1 continuously runs through the apparatus at high speed and it passes into the apparatus undertension in order that the material web 1, on being bent, does so uniformly and with the same level of material consumption. The tension of the material web 1 may, for example, be realized by some form of magnetic brake.

Simultaneously and likewise continuously, one or more strips 9 are fed into the apparatus from one or more magazine reels (not shown). The feed roller 10 of the strip 9 makes a predetermined stroke and feeds out as much strip 9 as is desired and transfers it to the transfer roller 11 on contact therewith. The transfer roller 11, whose surface is provided with holes connected to a vacuum source, retains the strip end. The transfer roller 11 coincides intermittently with the knife roller 12 which cuts off the strip end into a strip piece. The strip piece continues, retained by the vacuum apertures of the transfer roller 11, around the transfer roller 11 and to the sealing device 3. That sealing device 3 which is in turn to receive the strip piece or strip pieces is located in the position that the upper part 5 is open and separated from the lower part 6 and the lower part 6 is activated so that the lower part 6 is raised up from the surface of the station drum 2. Both of the strip pieces are retained by vacuum on the sealing devices 3. In those cases which relate to application of a so-called spout strip, the strip pieces enter axially towards the station drum 2 and it is then only one strip 9 that is applied.

The station drum 2 rotates such that the sealing device 3 which received strip pieces approaches the material web 1. At this point, the lower part 6 of the sealing device 3 is deactivated so that the material web 1 will not disturb the strip piece fixedly retained there. At the same time, the upper part 5 of the sealing device 3 is lowered over the lower part 6 with the aid of, for example, a cam. In this instance, it is those two parts 7 and 8 of the displacement means which are placed in the extension of the sealing device 3 which are operative to displace the material web 1 by grasping the material web 1 and drawing it through the apparatus.

The material web 1 is now located a distance into the apparatus retained by the displacement means parts 7 and 8 and surrounded on either side by a strip piece, namely the pull-tab strip and the cover strip, held on the surface of the sealing devices 3. The lower sealing device part 6 is now once again activated so that the strips are moved up towards the material web 1. The sealing devices 3 now execute a sealing operation and in this instance apply the strip pieces one from each side of the material web 1, with some form of heat sealing which may, for example, consist of induction heating or the like. The station drum 2 rotates constantly during this process and, in such instance, there will be obtained sufficient sealing time so that the strip pieces will also have time to cool and be retained on the material web surface without risk of subsequent leakage.

Simultaneously with the above-described procedure, it is necessary that the material web 1 be kept in register such that the strip 9 is always sited at its intended position on the material web 1 and ideally over its intended hole. In such an instance, a roller 15 on the rotating register maintenance device wheel 14 moves transversely in towards the material web 1 and forces the material web 1 in between the sealing devices 3. How much of the material web 1 is forced in between the sealing devices 3 will depend on that read-off which takes place of the bar code of the material web, a code which indicates the register maintenance. Via an encoder, the register maintenance device is controlled so that the transverse movement in towards the material web 1 will be larger or smaller.

The material web 1 departs from the apparatus at a slightly higher speed than it had on entry into the apparatus, with a view to counteracting slippage against the next sealing device 3. The material web now passes on through the machine, such as to a sterile bath or the like in order subsequently to be formed into a tube, filled with the intended contents and cut off into individual packages.

The apparatus according to the invention may suitably be controlled by the control system of the filling machine proper and otherwise requires slight supervision. In possible stoppage of the filling machine, that sealing device 3 which had commenced a sealing operation completes this operation and when the machine restarts, the next sealing device 3 starts in sequence. By such means, waste of packages will be reduced and at the same time the risk is avoided of obtaining packages which are not satisfactorily sealed in the opening arrangement.

By varying the diameter of the station drum 2 and moving the other parts included in the apparatus in relation thereto, application can be effected at different register lengths and, thereby, different package sizes. By means of a number of interchangeable station drums 2, the commonest package sizes can be applied.

As will have been apparent from the above description, the present invention realizes a continual apparatus for application of strip pieces to a continuous material web which can be utilized in today's rapid filling machines where it is required that the material web need not be stopped for this operational phase. Given that the apparatus is built into the filling machine, use is preferably made of the control system and the driving power of the filling machine for the apparatus. Furthermore, an exact and reliable application will be obtained of the strip while retaining the printing register. As a result of the compactness of the apparatus with short distances between hole-making and sealing, and given that the pull-tab strip and cover strip are applied simultaneously, the number of "misapplied" packages is reduced.

The present invention should not be considered as restricted to that described above and shown on the Drawings, many modifications being conceivable without departing from the spirit and scope of the appended Claims.

What is claimed is:

1. An apparatus for application of a strip to a web, comprising:

a rotatable drum;

a plurality of sealing devices pivotally attached to a periphery of the drum;

means for providing a supply of strips to the sealing devices;

means for advancing a material web around at least a portion of the drum;

means for maintaining register between the material web and the strips; and means for pivoting the sealing devices to seal the strips to the material web.

2. The apparatus as claimed in claim 1, wherein the advancing means are formed integrally with the sealing devices.

3. The apparatus as claimed in claim 1, further comprising one or more idlers disposed between two or more of the sealing devices disposed about the periphery of the drum.

4. The apparatus as claimed in claim 1, wherein each sealing device includes an upper and a lower part, each of the upper and lower parts including means, connected to a vacuum source, for holding one or more strips to the upper and lower part.

5. The apparatus as claimed in claim 4, wherein the pivoting means includes cam means for permitting movement of the upper parts of the sealing devices to open positions and for moving the upper parts to closed positions.

6. The apparatus as claimed in claim 5, wherein the pivoting means includes spring means for moving the upper parts to the open positions.

7. The apparatus as claimed in claim 4, wherein, for each sealing device, the upper part is, in the closed position, brought together with the lower part to seal one or more strips to the material web.

8. The apparatus as claimed in claim 4, further comprising pneumatic piston and cylinder assemblies for moving the lower parts of the sealing devices between activated and deactivated positions.

9. The apparatus as claimed in claim 8, wherein the lower parts are, in the activated positions, disposed at a greater distance from a center point of the drum than in the deactivated positions.

10. The apparatus as claimed in claim 1, wherein the means for providing the supply of strips includes a feed roller for feeding a length of strip material, a transfer roller adapted to retain, on a surface thereof, the length of strip material, and a knife roller adapted to cut the length of strip material retained on the surface of the transfer roller into one of the strips.

11. The apparatus as claimed in claim 10, wherein the surface of the transfer roller is provided with holes connected to a vacuum source for retaining the length of strip material and the one of the strips cut from the length of strip material.

12. The apparatus as claimed in claim 10, wherein a portion of the surface of the transfer roller intended to contact the knife roller is inlaid with a harder material than another, non-contacting portion of the transfer roller.

13. The apparatus as claimed in claim 1, wherein the register maintenance means includes a wheel provided with a plurality of radially arranged rollers.

14. The apparatus as claimed in claim 1, wherein the register maintenance means rotates with and transversely moves the material web toward the drum.

15. The apparatus as claimed in claim 14, further comprising means for varying an amount of transverse movement of the material web toward the drum by the register maintenance.

16. An apparatus for applying one or more strips to a material web, comprising:

a rotatable drum;

a plurality of sealing devices attached to the periphery of the drum, each sealing device including a first portion mounted on the drum and a second portion, hinge means joining the second portion to the first portion;

means for providing a supply of strips to the sealing devices;

means associated with at least one of the first and second portions of each of the sealing devices for holding one or more strips relative to at least one of the first and second portions of each of the sealing devices;

means for advancing a material web around at least a portion of the drum;

means for maintaining register between the material web and the strips; and means for pivoting the second portion of the sealing devices relative to the first portion to press the strips to a predetermined location on the material web, thereby sealing a strip to the web at the predetermined location.

17. The apparatus as set forth in claim 16, further comprising means for moving the first portion of one of the plurality of sealing devices radially relative to the drum.

18. The apparatus as set forth in claim 16, wherein the register maintenance means includes a roller adapted to contact the material web and move the material web toward a center of the drum.

19. The apparatus as set forth in claim 18, further comprising means for moving the roller toward the center of the drum.

20. The apparatus as set forth in claim 19, wherein the roller moving means includes means, responsive to a register between the one or more strips and the material web, for controlling an amount of movement of the roller toward the center of the drum.

* * * * *